US012667759B2

(12) United States Patent
Sizemore, Jr.

(10) Patent No.: US 12,667,759 B2
(45) Date of Patent: Jun. 30, 2026

(54) GOLF CLUB GRIP ASSEMBLY

(71) Applicant: Mod Golf Technologies, LLC, Jackson, MI (US)

(72) Inventor: Bruce E. Sizemore, Jr., Jackson, MI (US)

(73) Assignee: Mod Golf Technologies, LLC, Jackson, MI (US)

( * ) Notice: Subject to any disclaimer, the term of this patent is extended or adjusted under 35 U.S.C. 154(b) by 963 days.

(21) Appl. No.: 17/632,275

(22) PCT Filed: Aug. 6, 2020

(86) PCT No.: PCT/US2020/045300

§ 371 (c)(1),
(2) Date: Feb. 2, 2022

(87) PCT Pub. No.: WO2021/026406

PCT Pub. Date: Feb. 11, 2021

(65) Prior Publication Data

US 2022/0347532 A1 Nov. 3, 2022

Related U.S. Application Data

(60) Provisional application No. 62/913,582, filed on Oct. 10, 2019, provisional application No. 62/883,500, filed on Aug. 6, 2019.

(51) Int. Cl.

| | |
|---|---|
| ***A63B 53/14*** | (2015.01) |
| ***A63B 60/14*** | (2015.01) |
| ***A63B 60/24*** | (2015.01) |

(52) U.S. Cl.

CPC ..... *A63B 53/14* (2013.01); *A63B 60/14* (2015.10); *A63B 60/24* (2015.10)

(58) Field of Classification Search

CPC ..... A63B 53/14; A63B 60/14

See application file for complete search history.

(56) References Cited

U.S. PATENT DOCUMENTS

| | | | |
|---|---|---|---|
| 2,627,410 | A | 2/1953 | Mishkinis |
| 3,028,283 | A | 4/1962 | Lundgren et al. |

(Continued)

FOREIGN PATENT DOCUMENTS

| | | | |
|---|---|---|---|
| JP | 1994031769 | U | 4/1994 |
| JP | 9192267 | A | 7/1997 |

(Continued)

*Primary Examiner* — Eugene L Kim
*Assistant Examiner* — Christopher Glenn
(74) *Attorney, Agent, or Firm* — Warner Norcross + Judd LLP

(57) ABSTRACT

An interchangeable and weight adjustable golf grip including at least an end cap body having integral receiving ports adapted to receive variable weights, electronic chips, sensors, gauges, lasers, cameras, or biometrics within and wherein the end cap is capable of housing the various weights, chips, sensors, etc. within the end cap so that a player can interchange the weights or sensors without removing the golf grip from the shaft in order to make adjustments and so that the player can play golf without removing any other portions of the grip. Further, the invention includes contemplation of a tip collette with integral receiving ports adapted to also harbor similar weights, or sensors, etc. Data from the sensors may be transmitted by Bluetooth transmission to a smartphone or a ball launch monitor system for analysis.

3 Claims, 13 Drawing Sheets

(56) References Cited

U.S. PATENT DOCUMENTS

| | | | | |
|---|---|---|---|---|
| 3,295,850 | A | 1/1967 | Garrity | |
| 5,465,967 | A * | 11/1995 | Boeckenhaupt | A63B 60/24 473/297 |
| 6,511,386 | B1 * | 1/2003 | Cacicedo | A63B 60/10 473/549 |
| 10,099,101 | B1 | 10/2018 | Dingman et al. | |
| 2003/0104875 | A1 | 6/2003 | Markwood | |
| 2004/0038762 | A1 | 2/2004 | Okamoto | |
| 2009/0131194 | A1 * | 5/2009 | Keough | A63B 60/24 473/285 |
| 2009/0318242 | A1 | 12/2009 | Fujimoto | |
| 2010/0323832 | A1 | 12/2010 | Aaron | |
| 2011/0165958 | A1 * | 7/2011 | Hachiro | A63B 60/08 473/300 |
| 2013/0203517 | A1 | 8/2013 | Bolane et al. | |
| 2013/0288812 | A1 | 10/2013 | Kato et al. | |
| 2015/0328512 | A1 | 11/2015 | Davis et al. | |
| 2016/0271467 | A1 | 9/2016 | Wallin et al. | |
| 2018/0117432 | A1 * | 5/2018 | Aliberti | A63B 53/14 |
| 2018/0147463 | A1 * | 5/2018 | Breeden, III | A63B 53/14 |
| 2018/0361214 | A1 * | 12/2018 | Johnson | A63B 53/14 |

FOREIGN PATENT DOCUMENTS

| | | | |
|---|---|---|---|
| JP | 2010088844 | A | 4/2010 |
| WO | 2015134574 | A1 | 9/2015 |

* cited by examiner

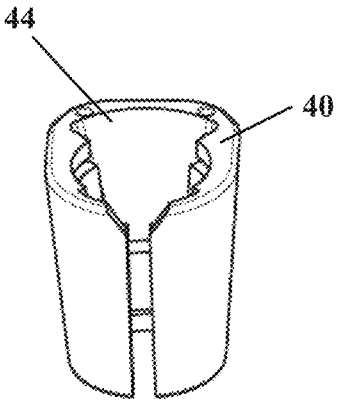
FIG. 3C
FIG. 3A
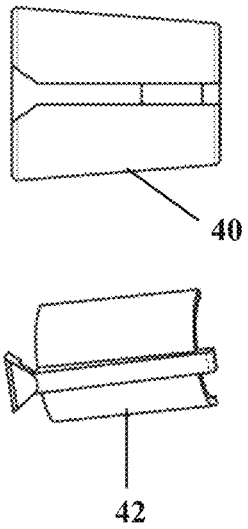
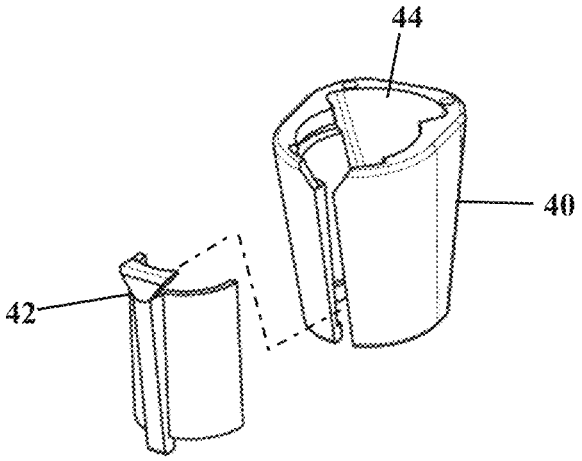
FIG. 3B

FIG. 4A
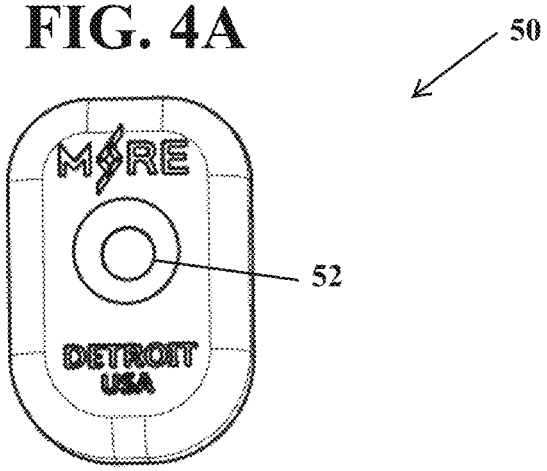
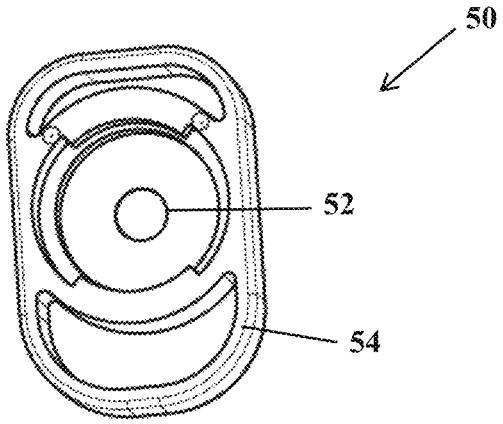
FIG. 4B

FIG. 5C
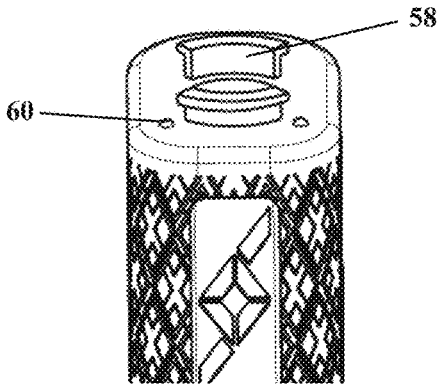
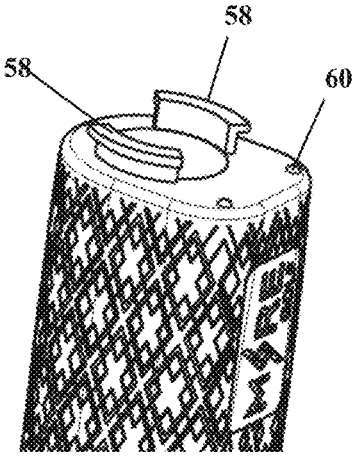
FIG. 5B
FIG. 5A
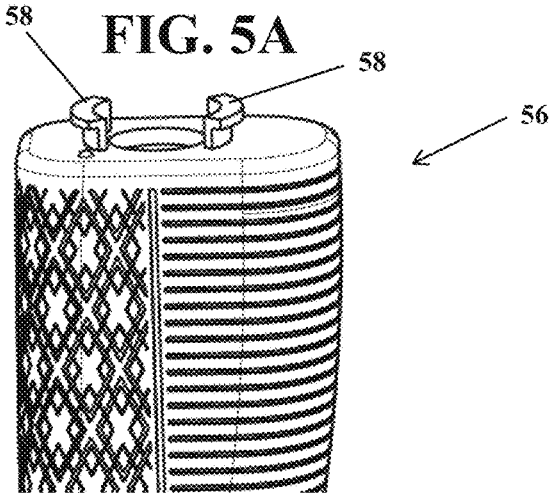

GOLF CLUB GRIP ASSEMBLY

CROSS-REFERENCE TO RELATED APPLICATIONS

This application claims the benefit under 35 U.S.C. 119(e) of U.S. Provisional Patent Application No. 62/883,500, filed on Aug. 6, 2019 and U.S. Provisional Patent Application No. 62/913,582, filed on Oct. 10, 2019.

BACKGROUND OF THE INVENTION

1. Field of the Invention

The present invention relates to golf grips, methods of manufacturing same, and methods of using same. More particularly, the invention relates to an interchangeable and weight adjustable golf grip, one with interchangeable and weight adjustable end caps and/or tip collettes, a universal golf grip inner sleeve adapter capable of receiving various golf grip profiles and styles of outer sleeves gripping layers thereover for custom fitting a golf grip to a golfer, and an optional variety of integral sensors and electronic analytics for monitoring swing characteristics as well as biometrics.

2. Description of the Prior Art

Conventional golf grips are well known in the art, including the most common types of putter and swing grips that generally include a rubber-like textured surface over a body sleeved over a golf shaft. The grip portion is held by the golfer, using the grippable surface during play.

While there are other companies that provide temporary training aids that can only adjust the weight at the distal end of the golf club, we do not know of any company that provides an interchangeable, adjustable weighting system at both ends of the golf grip that may remain permanently affixed within the golf club grip, or in its multi-component accessories for use during play. Prior art training aids for collecting data have been bulky, and are not quickly interchangeable for customization out on the course depending upon the particular conditions that the golfer is encountering.

Furthermore, and in addition, grip fitters, users and practitioners of prior art grips have become aware of certain problems with lengthy fitting times which are presented by those prior art inventions. One particular problem that has plagued users and sellers has been that it has taken a long time to re-grip a club. Re-gripping a club can take up to one half hour or more, meaning that the custom fitters can only re-grip a small number of clubs in a day. Generally, this gives rise to a need to leave one's club at the club fitters and come back to retrieve it afterward.

In order to solve these problems, golfers need the ability to immediately try different grip profiles, sizes and styles on any putter or golf club. It would be of a great advantage to the golfing industry if there was provided a quick method of interchanging different golf grips having various styles, sizes or profiles, whether on a putter or a swing club, a method of making it, and a method of using a quick golf grip interchange system.

It would be desirable to the golfing industry if there was provided an improved golf grip assembly capable of being custom fit with variable weights in two locations, i.e. in both the end cap as well as the tip collette. Further desirable, as well, is a series of sensors integral within the grip structure for collecting and transmitting gathered data and analytics of performance and playability metrics. Such a golf grip allows golf club fitters and players to customize and personalize their golf grips with ease.

SUMMARY OF THE INVENTION

In accordance with the above-noted desires of the industry, the present invention provides various aspects, including a novel golf club grip design capable of being custom fit to accommodate the natural and inherent swing profiles and preferences of the golfer. This new golf club grip may also be combined with various disclosed individual components, including weights, sensors, lasers, cameras, gauges, accelerometers, and other sensors and analytics, all of which may be used together to collect data, analytics, and other valuable information that the golfer can use to improve his game. Such weights and data collection methods are adapted to be received in, on or below the grip designed and they are designed to be interchangeable to optimize the fit of the golf club grip for individual golfers to enhance their swing. Methods of making the same, and a method of using the various components are also disclosed.

In particular, a first aspect of the present invention includes an end cap located at the distal end of the golf club grip with receiving ports for easily inserting and interchanging variable weights, as well as a tip collette that also includes weight and sensor chip receiving ports and combinations thereof. This overcomes many of the aforementioned problems with the prior art because the weight of the overall grip can be proportioned to help a golfer to correct any inherent swing deficiencies.

A second aspect of the invention includes a universal grip style fitting system including an inner sleeve to interchangeably receive a selected underlisting and different grip style thereover, so that different styles of grips can be almost immediately interchanged on the floor of the grip fitter. This is particularly useful for applications of custom fitting a golf club grip while the universal grip style inner sleeve remains on the golf club shaft, and easily slip a new grip style over the inner sleeve, so that a golfer may immediately try out various grip style to achieve optimal swing path, swing arc, tempo and lag.

One specific preferred aspect has certain features including an inner sleeve with a locating rib thereon and an outer sleeve having a recess that is complementary to the locating rib, so that the outer sleeve can easily be slid down over the inner sleeve for re-gripping the golf club in less than a minute.

This technique of quickly interchanging a golf grip on a shaft may therefore be extended to include not only the original fitting of a golf grip, but also the selling of an instantaneously interchanged golf grip at the reseller, thereby allowing decisions to be made quickly of which golf grip to purchase. Another preferred aspect has other features including variable weight receptacles within both the end cap and the tip collette for receiving various weights in combination with the inner and outer interchangeable sleeves and further custom grip fitting benefits.

The invention is particularly useful for applications of custom fitting of a golf grip having various styles, sizes or profiles to act as a sort of trial run before the final re-gripping of a golf club.

Although the invention will be described by way of examples hereinbelow for specific aspects having certain features, it must also be realized that minor modifications that do not require undo experimentation on the part of the practitioner are covered within the scope and breadth of this invention. Accordingly, the rest of the description will be regarded as illustrative rather than restrictive.

BRIEF DESCRIPTION OF THE DRAWINGS

For a further understanding of the nature and advantages of the expected scope and various aspects of the present invention, reference shall be made to the following detailed description, and when taken in conjunction with the accompanying drawings, in which like parts are given the same reference numerals, and wherein;

FIG. 3A illustrates a perspective view of the tip collette and a preferred retainer clip made in accordance with the present invention;

FIG. 3B illustrates a perspective view of the weight receiving port of the tip collette;

FIG. 3C illustrates another top perspective view of the tip collette and retainer clip;

FIG. 4A shows a top plan view of the end cap made in accordance with the present invention;

FIG. 4B shows a bottom top plan view of the end cap made in accordance with the present invention;

FIG. 5A is a perspective view of the top of the golf grip with connectors for receiving and securing the end cap;

FIG. 5B is a perspective view of the top of the golf grip with connectors for receiving and securing the end cap;

FIG. 5C is yet another perspective view of the top of the golf grip with connectors for receiving and securing the end cap;

DETAILED DESCRIPTION OF THE INVENTION

Figure 1:
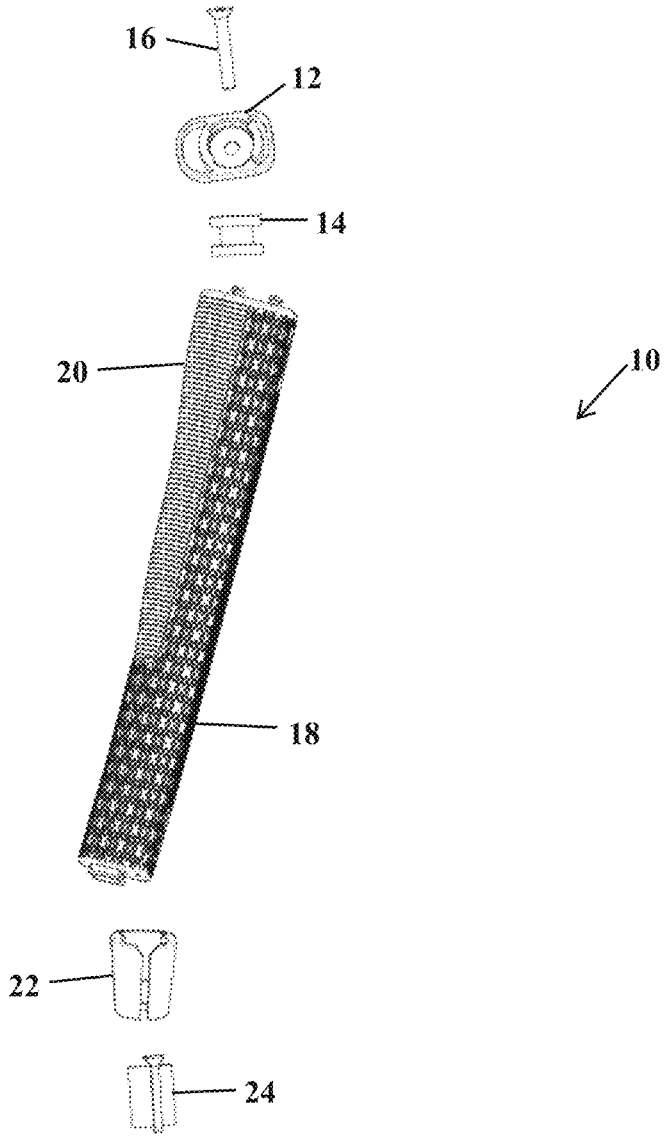
FIG. 1 is an exploded view of a customizable putter grip made in accordance with the present invention.

Referring now to the drawings in detail, FIG. 1 is an exploded view of a first aspect of the present invention where a putter golf club grip assembly is generally indicated by the numeral 10, which includes an end cap 12 and a tip collette 22, both capable of receiving various weights able to improve the golf swing. An optional retainer 14 may be held in place by retainer fastener 16 that can be press fit into the end of golf club grip 10. Besides press fitting, other suitable means for attachment are also contemplated.

A shaped golf putter grip body having a profile to optimize swing path and face rotation variables for a custom fit for inherent player preferences is disclosed comprising a flat front paddle with substantially parallel sides extending at least midway from the flat front paddle to the back of the putter grip body. The back of the putter grip body is rounded, preferably having a ratio of depth to width ratio being from 1:4 to 3:1.

The shaped golf putter grip body has a ratio of depth to width from 4:1 to 2:1 to influence and increase more arcing path and face rotation stroke. Preferably, the ratio of depth to width is 1:3 to influence a straighter path with less face rotation, while the ratio of depth to width is 1:1 to influence a more neutral path and face rotation.

The shape of the golf putter grip body has a tapered pistol style, while the shape of the body is substantially tapered cylindrical and made of a single integral piece. The body of the golf grip includes construction of an underlisting made of a material selected from the group consisting of composite materials, elastomers, thermoplastic elastomers, rubbers, vulcanized rubbers, metals, carbon, graphite, graphene, and combinations thereof. Further, the underlisting is made of a lattice structure in the form of a honeycomb configuration, a truss configuration, a chiral truss configuration, or a re-entrant honeycomb cellular lattice, composite, or a 3D printed composite.

In another aspect, the shaped golf putter grip body further comprises an overmold with an outer wrap gripping layer surface adhered to the underlisting, especially one having a vibration quotient. The outer wrap textured surface having dual depth texturing on the gripping layer surface is also advantageous. The dual depth texture includes a pattern of deeper channels and with an inner shallower channel pattern for enhanced surface roughness. The outer wrap is made of sheeted material selected from the group consisting of leather, polyurethane, dye sublimated polyester or nylon, rubber and combinations thereof. An applied coating on the outer wrap enhances tackiness, where the applied coating is slip resistant in wet and dry conditions, and is ultraviolet light stabilized and sweat resistant.

In another aspect for a golf swing grip body, the shape of the body is also substantially tapered cylindrical and made of a single integral piece. The shaped golf swing grip body also includes construction of an underlisting made of a material selected from the group consisting of composite materials, elastomers, thermoplastic plastic elastomers, rubbers, vulcanized rubbers, metals, carbon, graphite, graphene and combinations thereof formed into a lattice structure similar to that of the putter grip described above. Although a bit different in shape, the golf swing grip is made similarly to the golf putter grip.

Adjustable Weighting

Looking still to FIG. 1, golf grip outer covering 18 may be made with a textured pattern having a dual depth pattern that provides a substantially sweat resistant gripping surface during swinging of the putter. To achieve this, putter golf club grip 10 may include at least a portion of the exterior surface configured in a ribbed, pistol—style gripping surface 20. Further included is a tip collette 22 which may include a retainer clip 24 for holding the tip collette 22 in place. As an alternative aspect, and instead of the utilization of retainer clip 24, it is also contemplated that tip collette 22 may also be made with a living hinge to allow a quick on/off during the fitting. This is discussed in greater detail more fully hereinbelow.

Figures 2A, 2B, 2C:
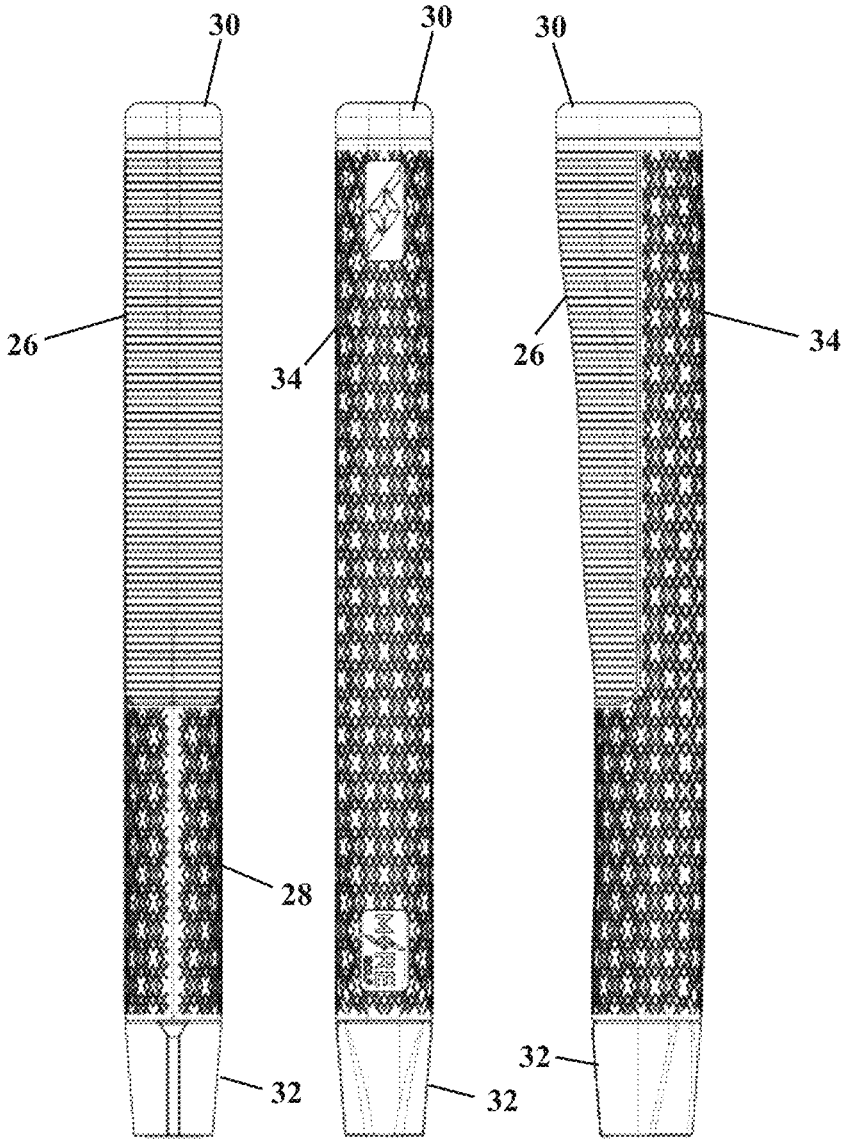
FIG. 2A illustrates a back elevational view of the back side the putter grip.
FIG. 2B illustrates a front elevational view of the front paddle of the putter grip.
FIG. 2C shows a side elevational view of the side the putter grip with a pistol grip configuration.

Collectively referring now to FIGS. 2A through 2C, there are views showing the various sides of the putter golf club grip including the backward facing pistol—style gripping surface 26, which is preferably made of a ribbed configuration. In this aspect, the pistol—style grip is preferably a dual diamond pattern textured gripping surface 28 for a better sweatproof grip. An end cap 30 is secured to the distal end of the golf grip. The putter golf grip preferably includes a front paddle 34 to receive the fingers of the golfer.

FIGS. 3A-3C show various views of tip collette 40 and tip collette retainer clip 42. As can be seen in FIG. 3B, a weight receiving port 44 is formed integral in the tip collette assembly. This weight receiving port may be adapted for receiving various weights, in order to provide custom fitting to a particular golfer's profile and preferences. Further, the weight receiving port may also receive chips, sensors, lasers, cameras, gauges, or any other desirable piece of electronic equipment to aid in custom fitting the golf club. The laser may have a port underneath so that the laser can point downward for the golfer to see where he has swung the club.

FIG. 4A is a top plan view of a preferred configuration of end cap 50, with an end securement hole 52 to receive a retainer fastener to the top of the golf club grip. FIG. 4B is a bottom plan view of the end cap 50, showing the weight receiving port 54 at the bottom, and possibly a sensor or semiconductor chip port at its top. Various weights can be added or subtracted depending upon the needs of the golfer to enhance his swing.

Collectively referring to FIGS. 5A-5C, the distal portion of the golf grip is generally denoted by numeral 56, and includes end cap alignment tabs 58 to receive the end cap shown in FIGS. 4A and 4B. Locator dimples 60 help to position the end cap to precisely locate the end cap when it is in position.

Figure 6:
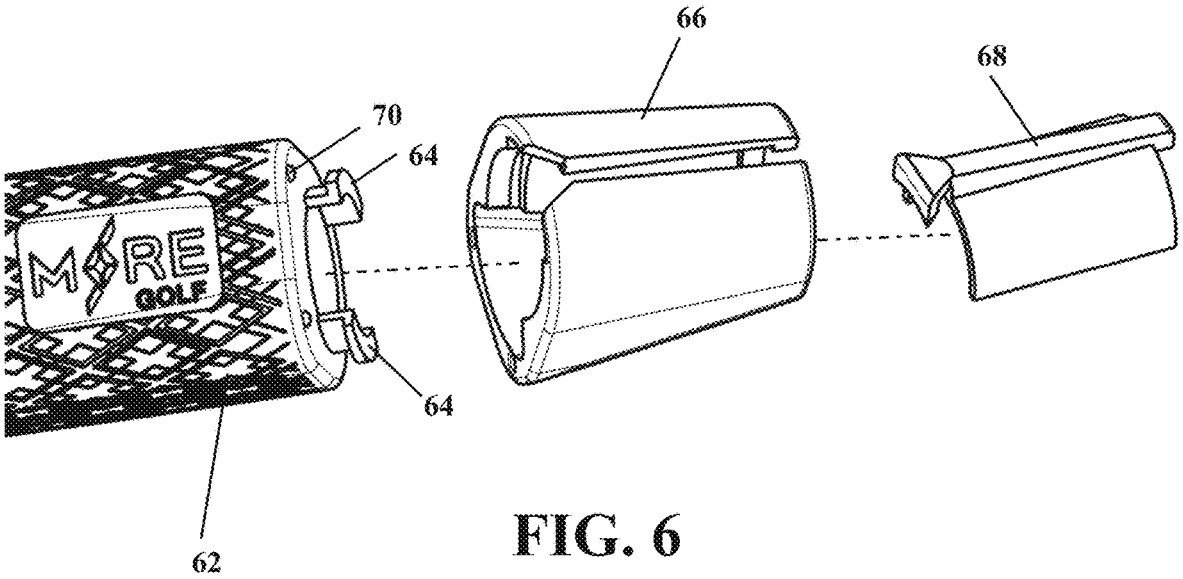
FIG. 6 is an exploded view of the bottom portion of the golf grip with connectors for receiving and securing the tip collette, the tip collette itself and a retaining clip.
Figure 7:
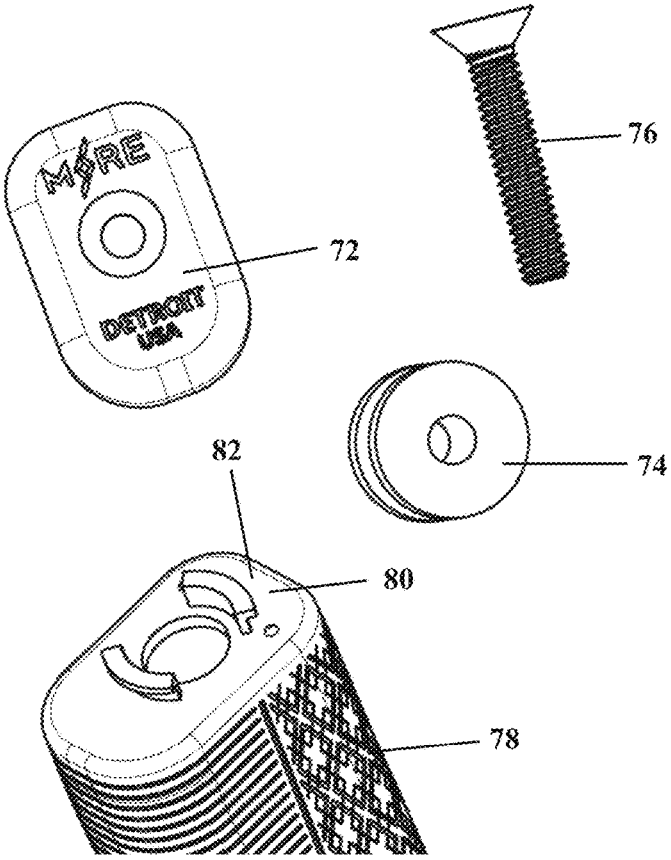
FIG. 7 is an exploded perspective view of the top of the golf grip with connectors for receiving and securing the end cap, along with the end cap, a press fit plunger and securement device.

FIG. 6 is an exploded perspective view of the proximal end of golf grip 62 showing connectors 64 and locator dimples 74 receiving tip collette 66. In this aspect, retainer clip 68 is used to hold tip collette in place once it has been snapped over the shaft which would be emanating from the proximal end of grip 62. Alternatively, tip collette 66 may have a living hinge to clip tip collette 66 into place.

Looking back up to the distal end of golf grip 78, connectors 82 and locator dimples 80 are adapted for receiving end 72. End retainer plug 74 may be press fit into golf grips 78 before end cap 72 is held in position by retainer fastener 76.

Figure 8:
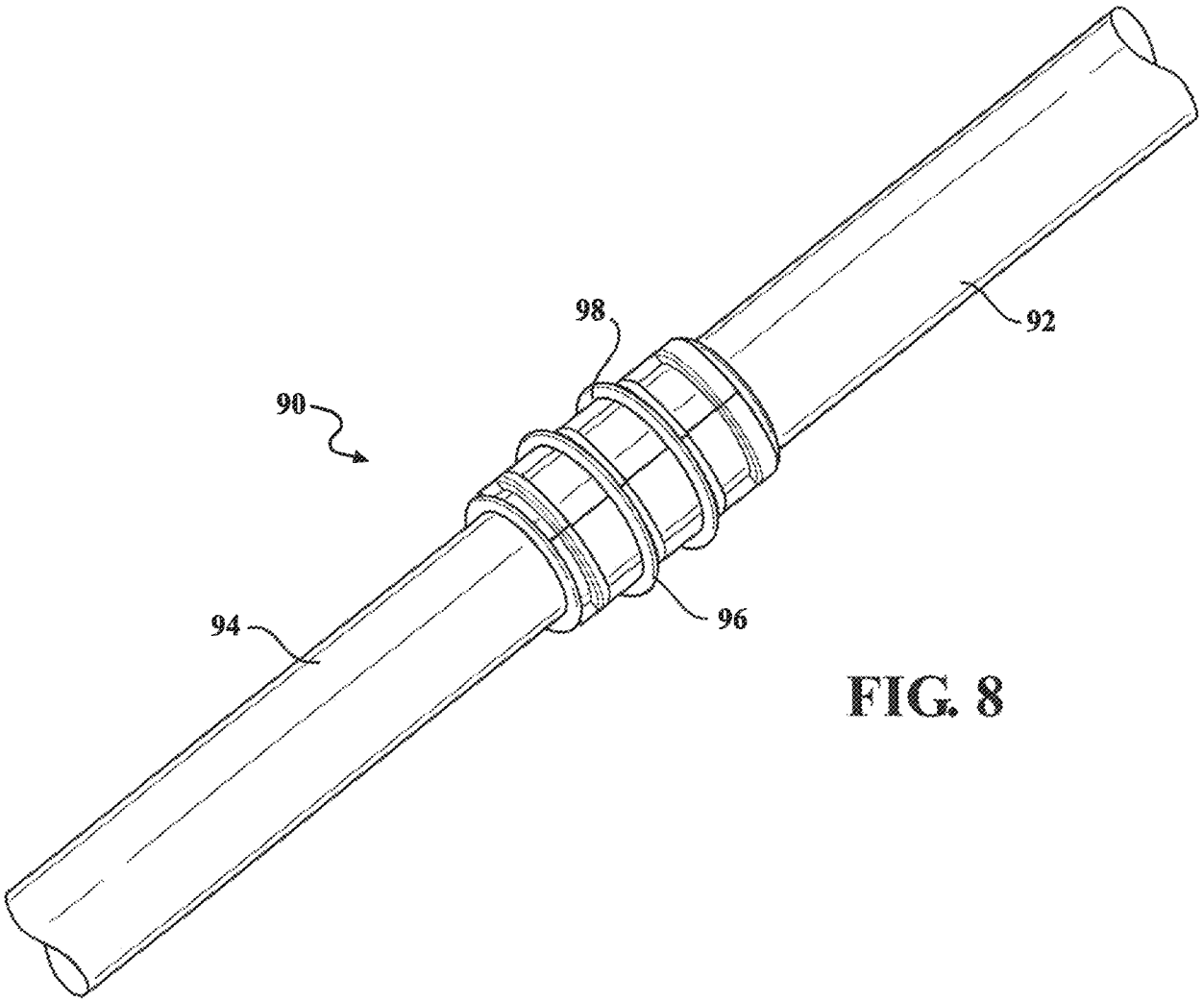
FIG. 8 illustrates a universal adapter for demonstrating the use of a weight at the tip collette position.

In another aspect of the present invention, FIG. 8 illustrates a universal grip adjustable weighting system 90 which may be clipped onto golf grip 92, for both a putter and a swing grip, on top of golf shaft 94. This universal grip weighting system 90 can include varying weights to be carried by a custom fitting golf pro to help adjust weights to determine the proper amount of weight to be added to the tip collette which will stay in place during play. This interchangeable and adjustable universal grip weighting system is a significant advance when determining how much weight is optimal at the proximal end of golf grip 92. Universal grip weighting system 90 can be adjusted for weight during a custom fitting so that a golf pro fitter can analyze the appropriate amount of weight to be put in the tip collette to enhance a golfer's swing path, arc, lag, all of which will affect the faceplate rotation of a golf club head to provide a more sure collision with the golf ball.

Figure 9B:
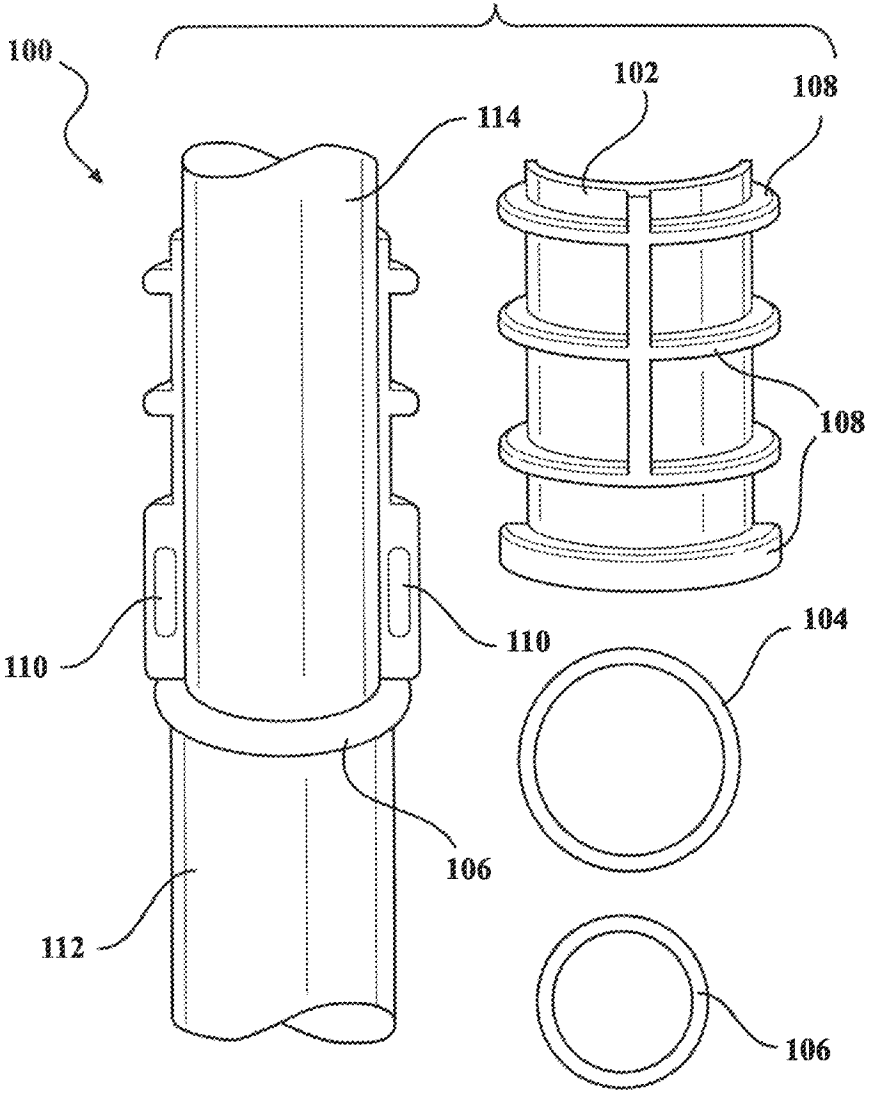
FIG. 9B details a half assembly of the universal adapter in position on a golf shaft in the tip collette position.
Figure 9A:
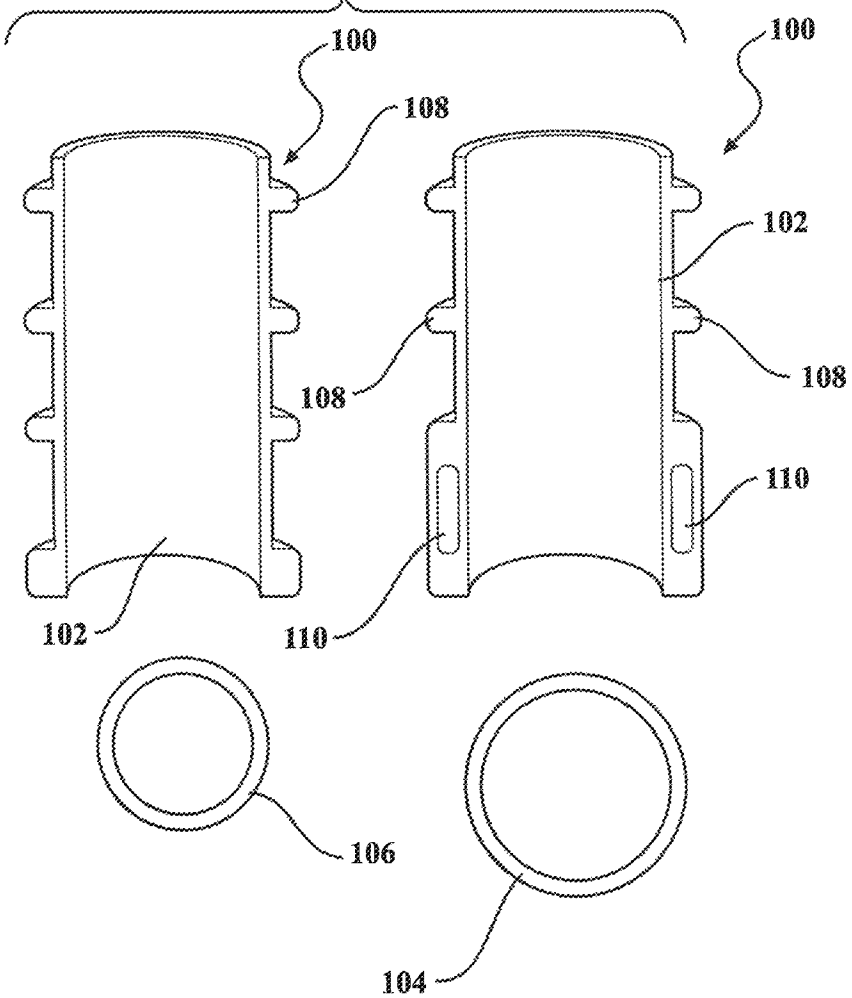
FIG. 9A shows an exploded view of the universal adapter for demonstrating the use of a variable weight on the golf shaft at the tip collette position with O-ring retainers.

FIG. 9A shows a universal weighted tip collette 100 in a split universal tip collette 102 configuration. A tip collette securement ring 104 is preferably a resilient rubber ring member along with a placement retention ring 106. Both of these securement rings 104 and 106, respectively, may include an O-ring or other suitable member for holding the universal tip collette 100 together to determine the amount of weight needed to correct any deficiencies in the swing of the golfer. O-ring retention grooves 108 will hold the tip collette and placement securement rings 104 and 106 in place during swinging.

FIG. 9B illustrates the universal weighted tip collette assembly 100 surrounding shaft 114. Universal weighted tip collette 100 is held against golf grip 112 by placement retainer ring 106. As can be seen in this assembly, split universal tip collette 102 is secured over shaft 114 and then the other half of split universal tip collette 102 is secured thereon by O-rings 104 in O-ring retention grooves 108.

Figure 9C:
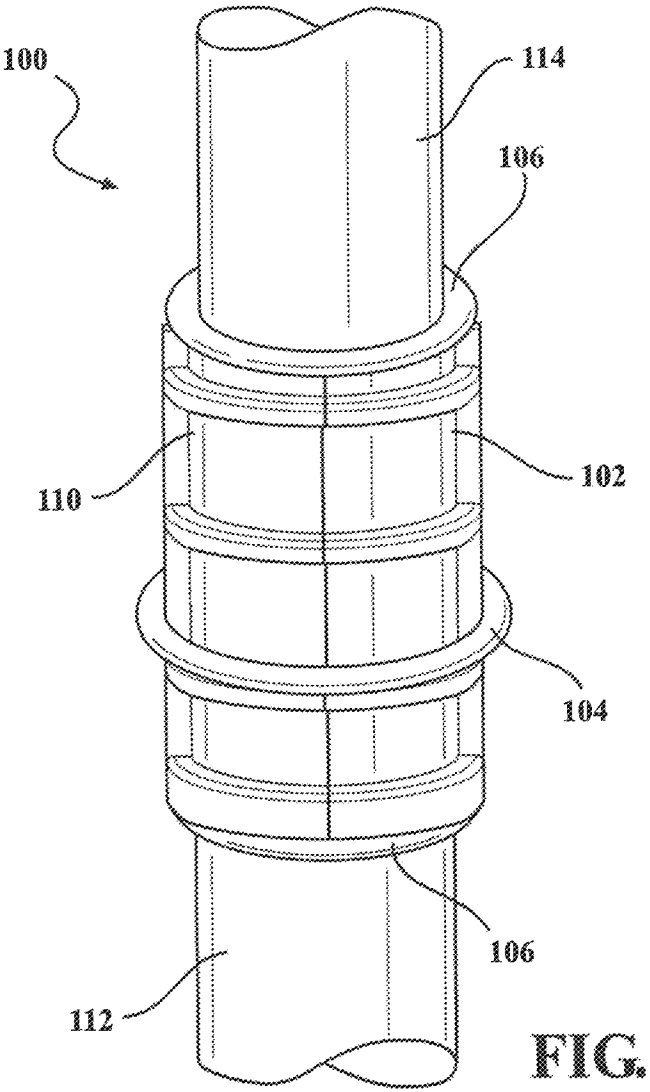
FIG. 9C details a full assembly of the universal adapter in position on a golf shaft in the tip collette position.

Looking next to FIG. 9C, universal weighted tip collette 100 is shown in a full assembly around shaft 114 on top of golf grip 112, held in place by tip collette securement ring 104 and positioned properly on shaft by placement retention rings 106.

Figure 10:
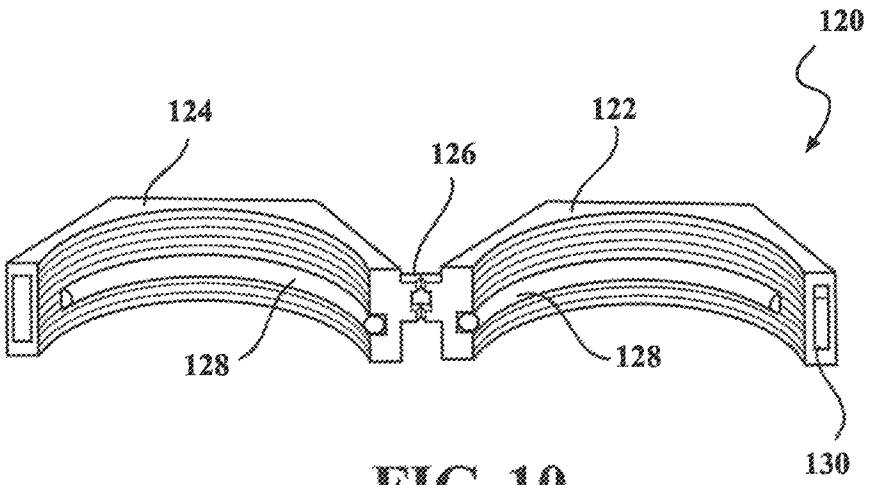
FIG. 10 shows another aspect of the weight adjustable universal adapter.

FIG. 10 shows another aspect of the present invention for the universal weighted tip collette 120 having a first clamshell half 122 and a second clamshell 124 held together by living hinge 126. Such a configuration means fewer pieces are needed to determine the variable tip collette weight, so that golf pros would not be able to lose additional pieces. A securement ring 128 may be embedded within a groove inside the tip collette 120 to help prevent slippage during swinging of the golf club.

Figure 11:
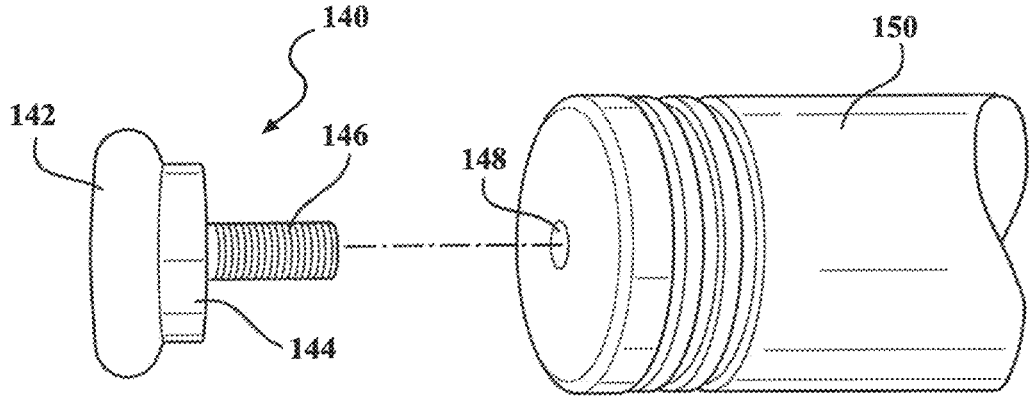
FIG. 11 shows a distal end of a swing grip with a weight for press fitting therein.

FIG. 11 illustrates yet another embodiment of the present invention, including a universal weighted end cap generally denoted by numeral 140, including an end cap 142 with a push stem 146 emanating therefrom. Push stem 146 may be threaded or not, and it is also capable of receiving various weights 144. Swing golf grip 150 has a conventional hole 148 which for this aspect acts as a stem receiver 148 so that push stem 146 can be manually inserted into stem receiver 148, without modification, as those that are generally utilized in other prior art end cap weight adjustments. Conventional end cap weight systems require coring out a larger hole so that a weight can be slid down into the interior shaft of golf grip 150. In the present aspect, no such modification is required. Further, in this aspect, the weights are external, making for a better variable weight adjustment system.

Figure 12:
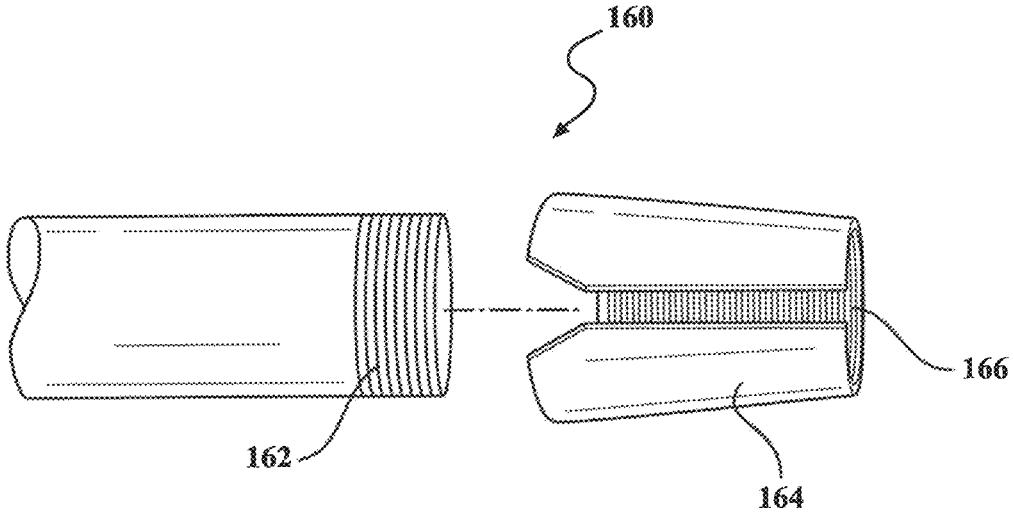
FIG. 12 shows an outside diameter threaded portion for receiving an adjustable tip collette having internal threads complementary to the OD threading.

Looking now to FIG. 12, there is shown yet another aspect of the present invention disclosing a threaded split tip collette 164 suitable for use on swing grips. Outside threads 162 on golf grip 162 are adapted to receive interior threads 166 that have been tapped into tip collette 164. In this configuration, tip collette 164 can be snapped over the shaft of the golf club and slid up towards the proximal end of golf grip 162 and threaded thereon for securement.

Figure 13A:
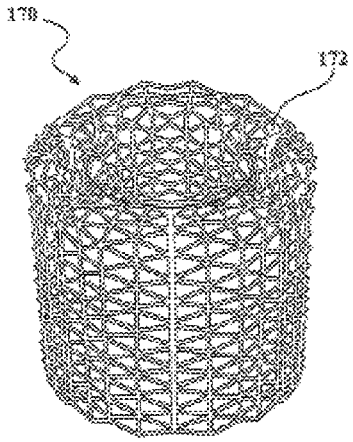
FIG. 13 shows a potential three dimensional lattice structure for golf grip underlisting without a semi-rigid exterior, then a partial exterior semi-rigid exterior, and finally a full covering.
Figure 13B:
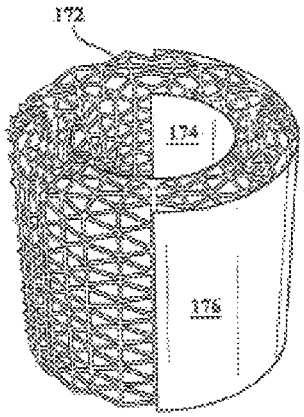
Figure 13C:
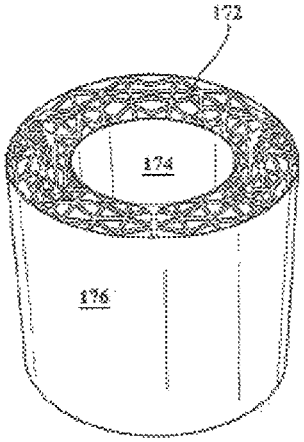

In practicing these aspects of the present invention, a golf grip body generally includes an underlisting within over mold configuration. The underlisting may include a resilient portion, such as a foam or a lattice structure such as the one illustrated here in FIG. 13. One possible method of manufacturing the underlisting is by using 3D additive manufacturing, which is easily capable of providing a lattice structure 170 having a 3D printed composite lattice 172. In this FIG. 13, there is shown a series of configurations of a potential lattice structure for the underlisting of golf grip 162 made in accordance with the present invention. The first drawing of the progression during manufacture is the lattice structure by itself, followed by a half completed structure within inner shaft sleeve 174 and a final progression including an outer solid covering 176, for integrity of the material.

Figure 14:
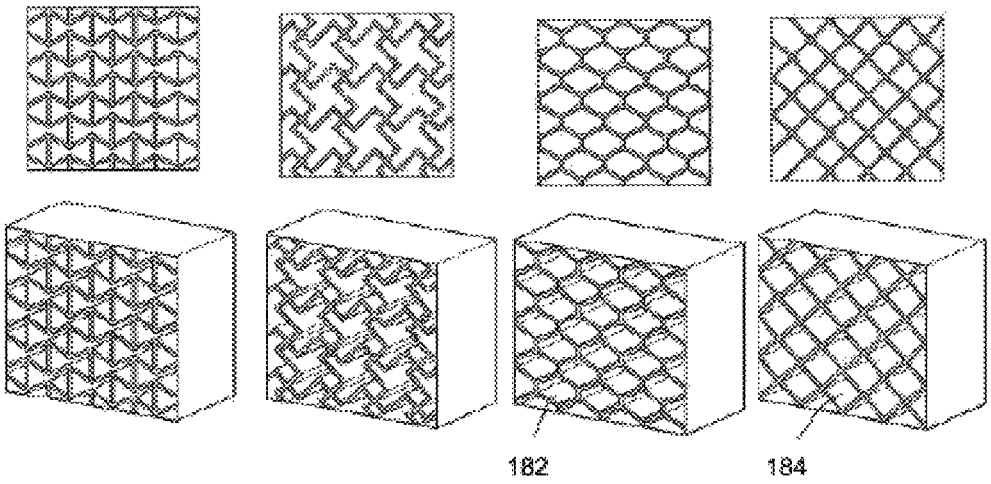
FIG. 14 shows various interlocking lattice type structures possible for the underlisting portion of the golf grip.

FIG. 14 shows a number of possible 3D printed composite lattice configurations, including a re-entrant honeycomb, a chiral truss, honeycomb 182, or truss 184. There are many other possible configurations, however, the honeycomb and the truss will allow for wires to be inserted therethrough in order to provide electrical communication for sensors, computer chips, lasers, cameras and all the other features that are disclosed hereinbelow.

Figure 15:
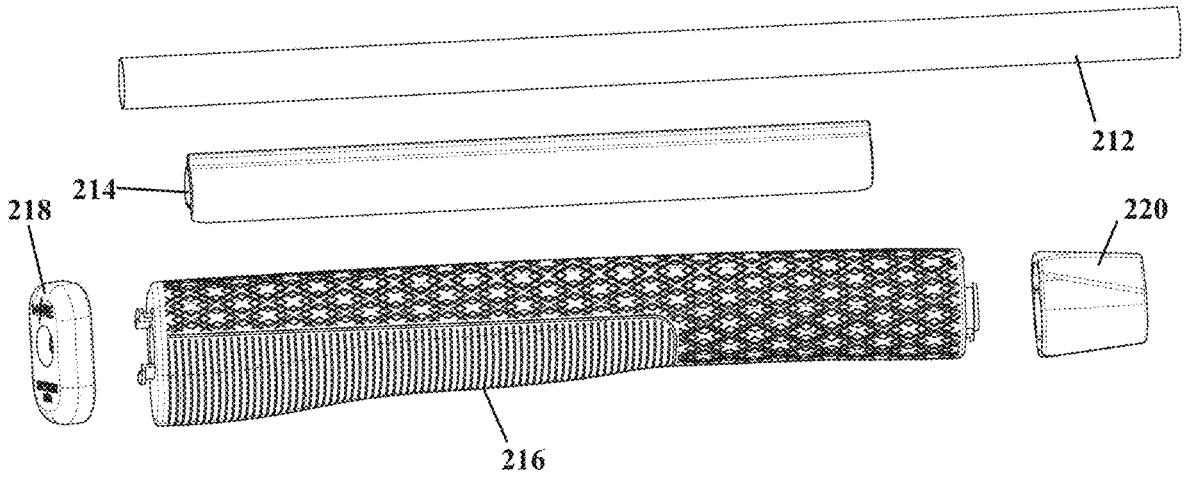
FIG. 15 is an exploded view of an interchangeable golf grip system made in accordance with the present invention.

Referring now to FIG. 15, illustrates yet another aspect of the present invention, with an exploded view of an interchangeable golf grip system generally indicated by the numeral 210, which also includes a golf club shaft 122, an inner sleeve 214 to be received over golf club shaft 212, and an outer sleeve grip surface 216 to be received over inner sleeve 214. Butt cap 218 will be secured to the distal end of outer sleeve grip surface 216, while tip collett 220 is adapted to be secured interchangeably at the proximal end of outer grip surface 216. Both the butt cap 218 and the tip collett 220 may include recesses therein for receiving various weights and/or sensors or lasers to provide better custom fitted golf grip.

FIG. 15 illustrates how an interchangeable golf putter or swing grip can be quickly interchanged for custom fitting purposes. Golf club shaft 212 receives inner sleeve 214 and tip collett 220. Inner sleeve 214 may be permanently or removably removed from golf club shaft 212, and inner sleeve 214 act as a substrate for receiving and outer sleeve grip surface 216 before butt cap 218 is secured onto the distal end of outer sleeve grip surface 216. Once outer sleeve grip surface 216 has been slid over inner sleeve 214 by matching locating rib 224 with a recessed inside outer sleeve 216, butt cap 218 can be utilized to carry various weights for custom fitting. Furthermore, the tip collett 220 may also optionally include cavities and/or recesses for receiving various weights to enable custom fitting, or, in the alternative, they also house a laser to provide a visual for a golfer while swinging.

Still referring to FIG. 15, an optional over covering (not shown here, but described below with reference to FIG. 20) may be useful over the outer sleeve grip surface 216 in order to provide a bit of real estate on the club for graphics, advertising, or decoration. This outer covering may be dye sublimated, or decorated in any suitable manner. Furthermore, such an outer covering may be used to include a sweat absorbent and/or sweat resistant material for comfort of the golfer using the club.

Figure 16:
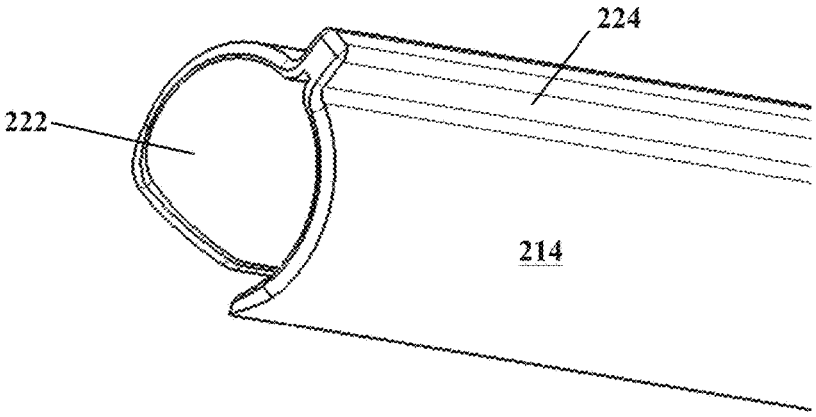
FIG. 16 details a close-up of the inner sleeve with a locating rib and a split back and widening taper at the tip end to conform to the taper of a shaft.

FIG. 16 is an end perspective view of inner sleeve 214, having a locating rib 224 along the longitudinal axis. In this aspect of the present invention, a curved corner 222 merely helps installing the inner sleeve onto a shaft in a very fast and efficient manner. Inner sleeve 214 may be injection molded, extruded or made in any other suitable manner to provide a polymeric, or somewhat elastic material such that when curved corner 222 is placed over a golf club shaft as shown previously, a nearly instant installation can be achieved. Curved corner 222 preferably also includes a split back feature that widens toward the tip end to naturally conform to the shaft taper. Although extrusion may be the preferred method of large-scale manufacturing such an inner sleeve 214, an additive manufacturing method, also known as 3-D printing, may provide an alternative for custom fitting of clubs without the need of to purchase tooling. Injection molding may also be utilized, along with any other suitable method of manufacturing.

Furthermore, one of ordinary skill in the art would realize that there are any number of suitable different locating pins, bumps, ribs or the like for securing an inner cavity of an outer sleeve (not shown here) in place over inner sleeve 214, to aid in securing the grip during swinging.

Figure 17:
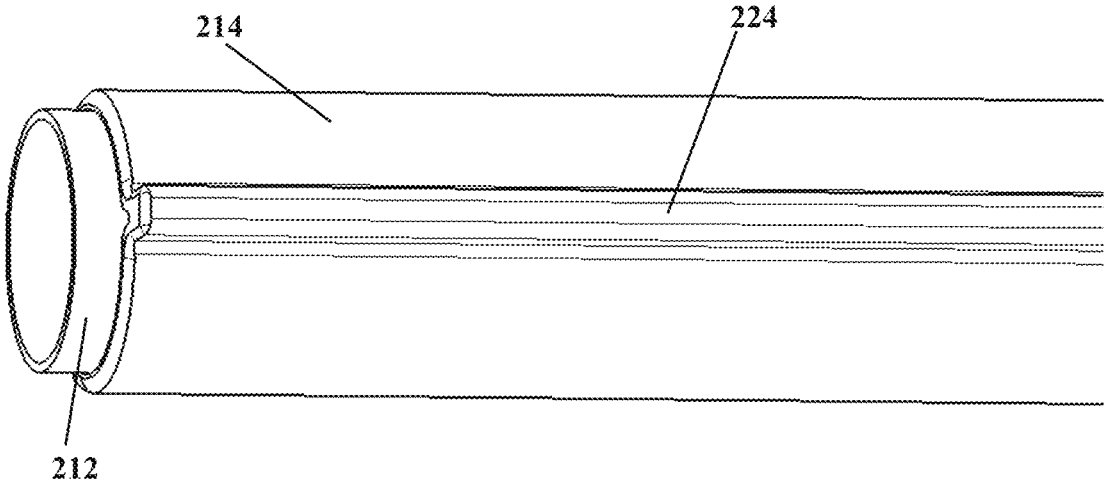
FIG. 17. is an end perspective view of the inner sleeve installed on the shaft of a golf club in accordance with present invention.

Looking next to FIG. 17, inner sleeve 214 is shown in proper placement over golf club shaft 212, with locating rib 224 extending along the longitudinal axis of golf club shaft 212. In this aspect, locating rib 224 will prevent twisting of the golf club grip, during play, and will provide a secure fitting of the outer sleeve during a custom fitting. Inner sleeve 214 can be applied to the golf club shaft 212 permanently or temporarily with adhesive so that the inner sleeve 214 can be removed or repositioned on any other golf club shaft.

Figure 18:
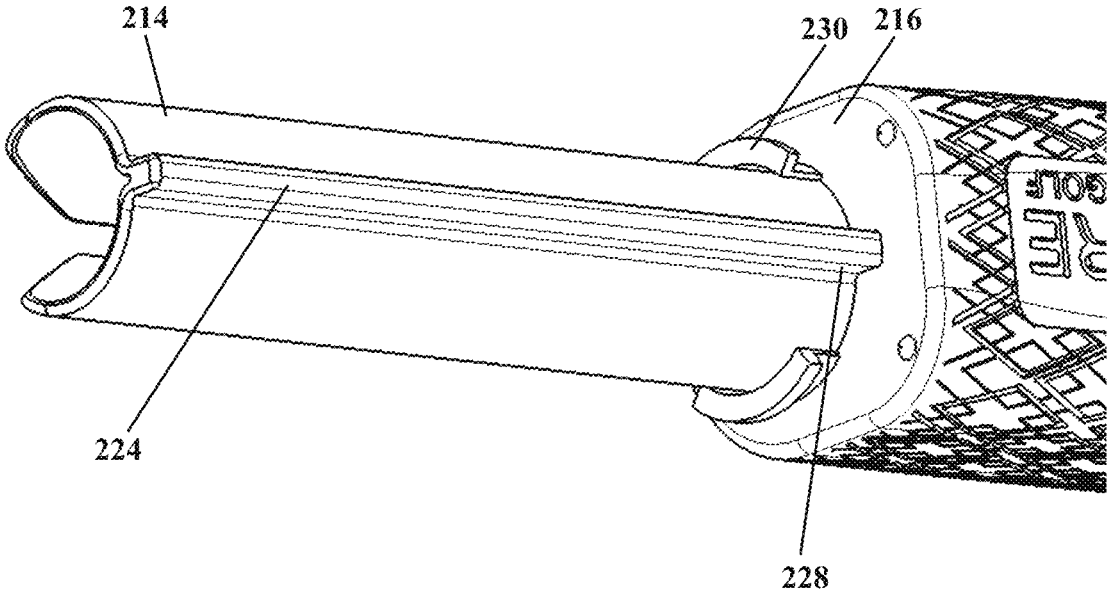
FIG. 18 is a perspective view showing the outer sleeve receiving the inner sleeve.

FIG. 18 is a close-up perspective view of inner sleeve 214 receiving outer sleeve 216, following a path of the locating rib 224. Outer sleeve golf grip surface 216 has been formed with an integral recess 228 that is complementary to the locating rib 224 of inner sleeve 214. As one can see from this figure, inner sleeve 214 will be entirely housed once outer sleeve 216 has been installed over inner sleeve 214, such that a butt cap will be able to be secured to butt cap receiver 230 to provide for custom fitting.

As educated consumers of golf club grips, one can appreciate the advantages of going to the putter corral or going to your custom fitted Pro shop and being able to nearly instantaneously try out different grips, providing greater information for a purchase. Prior art grip systems take from 11 minutes to some hours to make an installation, thereby making instantaneous interchangeability for custom fitting purposes nonexistent. To provide a better purchasing experience to an accomplished golfer, custom fitting their clubs and custom weighting their clubs within seconds would be a very important attribute.

A professional custom fitter would have various weights at his disposal to place in the butt cap and/or tip collett recesses, so that not only would the purchaser be able to feel different various styles, sizes or profiles of the gripping surface to match his desires, but custom weighting could be tested out at a moment's notice with the custom fitter's launch ball monitor to test out the various effects of placing weights at the butt end or the collett end. The determination can be made right there on the spot as to the most preferable weight distribution for that particular purchaser. Once the preferred weight distribution and gripping surface has been decided upon, those features could be permanently installed on a purchaser's golf club shaft. Since custom fitting used to be such a laborious task, the present invention can make the experience very pleasurable and much more accurate.

Such a multi-component golf grip includes a golf grip body having proximal and distal ends with a connector at its distal end, an interchangeable, weight adjustable end cap with a complementary connector to be received by the connector at the distal end of the golf grip body and the end cap being made of a material selected from the group consisting of metal, thermoplastic elastomers, composite materials, elastomers, thermoplastic elastomers, rubbers, vulcanized rubbers, metals, carbon, graphite, graphene, and combinations thereof. The end cap has weight ports integrally formed therein to receive various interchangeable weights, so that a golf club fitter can change the weight without changing the grip from the shaft. Horizontal and vertical securements keep the end cap in position, possibly with magnetic securements or quick disconnect couplings.

The interchangeable weights are generally useful from 1 gram to 100 grams, while the overall golf grip body is from 30 grams to 200 grams.

Furthermore, a multi-component golf grip made in accordance with the present invention includes a golf grip body having an interchangeable, removable, weight adjustable tip collette adapted for placement at the proximal end of the grip body. The tip collette has an integral complementary connector to be received at the proximal end of the golf grip body. Similar to the end cap, the tip collette is also preferably made of a material selected from the group consisting of metal, thermoplastic elastomers, composite materials, elastomers, thermoplastic elastomers, rubbers, vulcanized rubbers, metals, carbon, graphite, graphene, and combinations thereof. The tip collette also has weight ports integrally formed therein to receive various interchangeable various weights by material selection or additional weights, so that one can easily change the tip collette weight, and perform that change and adjusting quickly without removing the grip from the shaft. By changing the weights, the swing weight, total weight, balance point to retard or accelerate club rotation during the swing can be achieved. Typically, the weight ports are adapted to receive weights to adjust the weights from 3 grams to 100 grams.

The tip collette may be configured in a clamshell-like structure to clip onto the shaft for training, with a longitudinal split for slipping over the shaft and its ability to slide up into position at the proximal end of the golf grip body, and being adapted to receive a retainer or tip collette keeper. The clamshell configuration has a living hinge to connect the two halves of the clamshell.

A full feature interchangeable and adjustable golf grip includes an end cap body having integral receiving ports adapted to receive variable weights, electronic chips, sensors, gauges, lasers, cameras, biometrics, where the end cap includes cavities to house the weights, chips, sensors, etc. so that a player can interchange the weights without removing the golf grip from the shaft in order to make adjustments and so that the player can play golf without removing any portions of the grip.

Embedded Analytics and Sensors

The present invention also envisions the inclusion of many different types of data collections for swing analytics, such as computer chips, sensors, lasers, cameras, gauges and the like embedded into the golf grip of the present invention for regular golf play as well as training sessions. Some competitors use external analytics for stationary training aids, and generally, and some of those devices are stationed on the ground adjacent the golfer to detect swing data. Obviously, these are external to the golf club. Therefore, since the analytics and sensors of the present invention may be embedded into the golf grip itself, the embedded analytics and sensors can be used in regular play. Adjustments can be made to your swing while one is playing a round of golf. Prior art devices must be used by a custom fitter while he is watching or taking videos, and cannot be used continuously while playing a round of golf. Furthermore, in one aspect, the present invention envisions lasers and tiny cameras that point up out of the end cap to project on the chest of the player, or downwardly facing, coming out down from the tip collette to show the direction and path of the swing.

Further, this internal housing aspect of sensors embedded into a golf grip provides vibration resistance, weather resistance, proper alignment of detectors, interchangeability, along with other significant benefits. Sensors and chips located externally are susceptible to shifting of position during data collection and general degradation by exposure to the outer elements.

Sensors can be embedded within the golf club grip to also provide semi-medical measurements, such as grip pressure measurements, pulse rate of the golfer, blood pressure, and many other different types of biometric analyses capable from commercially available sensors. In addition, the swing metrics can also be integral with the golf club grip, so that analyses can be ongoing during a round of golf. Because the present invention includes these sensors, chips, lasers, cameras, gauges and the like within the golf club grip, a golfer can analyze his strokes from hole to hole, and provide continuing analysis during his round of golf. This is not possible with prior art devices. By providing ports within the present end cap and tip collette, at least two types of metrics be monitored ie. swing analytics and healthcare biometrics, resulting in dual chip technologies integral with the golf club grip of the present invention.

Beneficial metrics to be measured and analyzed include swing path, length, face angle (both dynamic and static), speed, static and dynamic loft, impact position and tempo, like a metronome. In order to measure these metrics, we utilize accelerometers, gyrometers, inertia meters and sensors, orientation sensors, GPS, club locators, metronomes, lasers, cameras, multiple cameras, heat mappers, Doppler radar, strain guages, piezoelectric devices, among others. Many of these sensors and analytics are divided into practice and in-play categories.

In using the present invention, an initial baseline or starting point is advantageously established to measure improvement, and to gain relevance of swing and stroke data being collected.

Dual Chip Technology

Because the golf grip assembly of the present invention provides receiving ports in both the end cap and the tip collette, dual chip technologies are possible. This dual chip capability is important for a number of the sensors, because there are at least two different locations to be matched. For example, while competitors may be able to use a gyrometer in their end cap, those gyrometers are extremely expensive and notoriously inaccurate. By utilizing both receiving ports in the end cap and the tip collette, much cheaper gyrometers can be utilized because now there are two locations to match against each other. This provides much better data, and the accuracy is greatly increased. Further, sensors and analytics may be placed intermediate within the golf grip body, in case three locations for data taking are advantageous, ie. in the end cap, the tip collette, and within the grip body itself.

Consequently, this dual-chip technology provides a dramatically increased amount of possible analytics, sensors and biometrics and other metric analyses data that can be transmitted to a smart phone by Bluetooth. The health of a golfer can even be monitored, with alarms to provide warnings of high pulse rates and the like. Also contemplated by the present invention is an audible metronome tempo sound generator embedded and/or integral into the golf club grip itself. Again, this can be utilized for a round of golf rather than just on the driving range while a golf pro is prompting you to swing the club in various fashions.

Rather like having a personal coach on your smartphone, the disclosed sensors and computer chips housed in the receiving ports of the end cap or in the tip collette are configured as swing analyzers. Along with a companion app that is Bluetooth connected to your smart phone, it will help a golfer to better understand his swing. For example, in a three dimensional swing analysis made by the present invention, the most important aspects of the swing can be measured and analyzed including club speed, hand speed, club plane, tempo, backswing length, and more. By reviewing your swing in three dimensions from any angle, recording your swing provides a way to compare historical data, possibly even with video of the actual swing.

Instant evaluation is possible by receiving immediate analysis and evaluations displayed on your smartphone or other smart device that help you focus your training. By taking a few swings, many helpful data points can be processed to identify the right training program, customized for each golfer. By testing the swing, a player can see how much improved and where training should be focused on next.

Grip Metrics and Analytics as a Delivery System to Integrate with Ball Launch Monitor Systems The present invention will also find substantial utility when metrics and analytics detected by sensors and computer chips, lasers and cameras, and all the other sensors and metrics described above, can be integrated into ball launch monitoring systems already owned by professional club fitters. The present invention contemplates true integration with ball launch monitoring companies, whether by Bluetooth or by direct sensing.

Torsion Control

Within the swing golf club grip and other aspects of the present invention, another feature includes a torsion control mechanism by incorporating torsion control memory materials for correcting centrifugal force created during the golf swing. By utilizing torsion control materials within the body of the golf club grip, rotation of the golf grip is limited, providing better face rotation when the golf club comes in contact with the golf ball. This can be accomplished by utilizing a torsion spring internal and embedded into the under listing, or may be incorporated into an over molded grip material. Such a torsion control embedded material provides counterbalance to rotational torsion that is created during the swing of the club. As a swing golf club is played, centrifugal force throws the toe of the club head outwardly due to a moment of inertia. An appropriate countermeasure torsion spring material resisting this centrifugal force will mean that the faceplate of the club head and the rotation thereof can be counteracted. This means that the face of the golf club contacts the ball in a better position for a straighter drive with less dispersion.

Further aspects of this torsion control feature include means for reducing torque, while maintaining a soft grip pressure. By removing the torsional component variable out of the feel of the grip, pressures remain more constant. To accomplish this, the present invention contemplates several scenarios, including twisted graphene in a spiral configuration molded right into the grip material memory, piezoelectric stiffeners molded into the grip, metals such as spring steel, tempered spring steel, memory semi-rigid plastics and polymers that are somewhat pre-twisted to resist rotational motion during a golf swing. Twisted graphene can provide a dual function as it has a high electrical connectivity, and may be used to put sensors in the end cap and the tip collette in electrical communication.

Due to pre-twisting of these materials during manufacture, dynamic energy is preloaded, in a manner of speaking, and upon swinging of the golf club, they resist rotational force because the pre-twisted material counteracts the centrifugal force created during the swing. Such memory materials are currently commercially available for eyeglasses, hardened spring steel pickup truck lift gates, among other applications. In some aspects, spring steel, memory polymers and the like can be molded into the underlisting, and/or the rubber grip composite in a circular cross section in order to resist twisting during a golf swing.

Therefore, this shaped golf swing grip body exhibits substantially low or no torque due to a pre-sprung counter-rotation. The counteracting torsion control mechanism counteracts surface torque naturally occurring during swinging of a golf club, including by a swing torsion spring. The counteracting torsion control mechanism can be made to accommodate controls for both right and left-handed golfers.

Remote Battery Recharging System

Powering the data collection and data display systems described hereinabove will require power from some rechargeable batteries that can be recharged by a wireless recharging plate put into the bottom of a golf bag. Rechargeable batteries will be incorporated into the golf grip body and electrically communicating with the sensors, lasers, cameras, etc. that require power. When the clubs are inserted into the bag, the rechargeable batteries in the golf grip body will come into close contact with the charger for the batteries and recharge them. Alternatively, a piezoelectric recharging system is envisioned that recharges the batteries every time the club swings. Any suitable method of recharging the batteries finds utility here.

In summary, numerous benefits have been described which result from employing any or all of the concepts and the features of the various specific aspects of the present invention, or those that are within the scope of the invention. The present interchangeable golf club grip system acts perfectly to be used for nearly instantaneous custom grip fitting, or re-gripping of one's golf club.

The foregoing description of several preferred aspects of the invention have been presented for purposes of illustration and description. It is not intended to be exhaustive or to limit the invention to the precise form disclosed. Obvious modifications or variations are possible in light of the above teachings with regards to the specific aspects. The aspect was chosen and described in order to best illustrate the principles of the invention and its practical applications to thereby enable one of ordinary skill in the art to best utilize the invention in various aspects and with various modifications as are suited to the particular use contemplated.

INDUSTRIAL APPLICABILITY

The present invention finds utility in the sports equipment industry, especially useful in the golf club arts.

What is claimed is:

1. An interchangeable and adjustable golf grip assembly having a golf grip body mounted on a shaft, the golf grip body having a distal end and a proximal end, the assembly comprising:

an end cap connected to the distal end of the grip body, the end cap having a lower edge and an upper edge defining an end cap depth therebetween, the upper edge spaced above the lower edge and the distal end of the grip body;

a tip collette connected to the proximal end of the grip body; and receiving ports integral with and completely housed within each of the end cap and the tip collette, the receiving ports within the end cap disposed between the upper edge and the lower edge of the end cap, the receiving ports housing sensors for measuring metrics related to at least one of a: swing path, length of shot, face angle (both dynamic and static), swing speed, static and dynamic loft, and impact position and tempo of a golfer's swing, the receiving ports being disposed in both the end cap and the tip collette enabling dual collection of the metrics with at least one of the sensors in the receiving ports of the end cap and at least one of the sensors in the receiving ports of the tip collette.

2. The interchangeable and adjustable golf grip assembly of claim 1, further comprising, within the receiving ports of each of the end cap and the tip collette, at least one sensor selected from the group consisting of accelerometers, gyrometers, inertia meters and sensors, orientation sensors, GPS, club locators, metronomes, lasers, cameras, multiple cameras, heat mappers, Doppler radar, strain gauges, piezoelectric devices, in order to measure the metrics of claim 1.

3. The interchangeable and adjustable golf grip assembly of claim 2, wherein the at least one sensor within the end cap receiving ports and the at least one sensor within the tip collette receiving ports for dual measuring and analyzing of one or more swing characteristics including swing path, length of shot, face angle, swing speed, static and dynamic loft, impact position and tempo, the dual measuring providing sensor data for each of the end cap and tip collette locations on the golf grip assembly.

* * * * *